US006035608A

United States Patent [19]

O'Connor

[11] Patent Number: 6,035,608

[45] **Date of Patent: *Mar. 14, 2000**

[54] PACKAGING A STRIP OF MATERIAL

[75] Inventor: Lawrence J. O'Connor, Winnipeg, Canada

[73] Assignee: Stac-Pac Technologies Inc., Christchurch, Barbados

[ * ] Notice: This patent is subject to a terminal disclaimer.

[21] Appl. No.: 08/878,826

[22] Filed: Jun. 19, 1997

[51] Int. Cl.[7] ..... B65B 63/04; B65B 31/00

[52] U.S. Cl. ..... 53/429; 53/434; 493/357; 493/363; 206/494; 206/524.8

[58] Field of Search ..... 53/429, 116, 117, 53/434, 435, 513, 520, 157; 206/494, 524.8; 493/413, 414, 415, 410, 411, 437, 448, 439, 440, 357, 356, 363

[56] References Cited

U.S. PATENT DOCUMENTS

| | | | |
|---|---|---|---|
| 32,761 | 7/1861 | Elliot . | |
| 1,463,918 | 8/1923 | Borroughs . | |
| 1,985,676 | 12/1934 | Hand . | |
| 3,245,680 | 4/1966 | Harrison et al. | 493/413 |
| 3,351,992 | 11/1967 | Carter | 53/429 |
| 3,673,757 | 7/1972 | Willis | 53/429 |
| 3,684,275 | 8/1972 | Schweitzer et al. | 493/413 X |
| 3,729,367 | 4/1973 | Shore et al. | 53/429 |
| 3,739,544 | 6/1973 | Hanemann . | |
| 4,097,039 | 6/1978 | Fischer | 493/413 |
| 4,201,029 | 5/1980 | Lerner et al. | 53/429 |
| 4,240,854 | 12/1980 | Massey et al. | 53/429 X |
| 4,418,514 | 12/1983 | Spann | 53/434 X |
| 4,427,404 | 1/1984 | Yamada . | |
| 4,499,707 | 2/1985 | Desjobert et al. . | |
| 4,547,184 | 10/1985 | Bunch, Jr. . | |
| 4,597,748 | 7/1986 | Wolf . | |
| 4,603,817 | 8/1986 | O'Connor . | |
| 4,716,706 | 1/1988 | Boeckmann . | |
| 4,896,475 | 1/1990 | McAvinew | 53/117 |
| 4,941,374 | 7/1990 | Focke | 53/157 X |
| 5,036,977 | 8/1991 | Schofield et al. . | |
| 5,064,179 | 11/1991 | Martin . | |
| 5,087,140 | 2/1992 | Keeton et al. . | |
| 5,104,366 | 4/1992 | Bunch | 493/414 X |
| 5,177,934 | 1/1993 | Yamamoto | 53/434 X |
| 5,290,226 | 3/1994 | Green, Jr. . | |
| 5,529,564 | 6/1996 | Hediger . | |
| 5,927,051 | 7/1999 | O'Connor et al. | 53/429 |

FOREIGN PATENT DOCUMENTS

| | | | |
|---|---|---|---|
| 22983/83 | 3/1986 | Australia . | |
| 383501 | 8/1990 | European Pat. Off. . | |
| 47638 | 3/1982 | Japan | 53/116 |
| 2-182666 | 7/1990 | Japan . | |
| 1555205 | 4/1990 | U.S.S.R. | 53/429 |

*Primary Examiner*—Linda Johnson
*Attorney, Agent, or Firm*—Oliff & Berridge, PLC; Adrian D. Battison

[57] ABSTRACT

A package of a continuous strip of material includes a plurality of parallel side by side stacks each containing a length of the strip which is folded back and forth such that each folded portion of the stack is folded relative to the next portion about a line transverse to the strip and such that the side edges of the strip portions are aligned. The strip is continuous through each stack and is connected from the end of one stack to beginning of the next stack by a traverse portion extending between the stacks. The package can be compressed to reduce the height of the stacks and maintained in the compressed condition by an evacuated sealed bag.

22 Claims, 4 Drawing Sheets

PACKAGING A STRIP OF MATERIAL

This invention relates to a a package of a strip of material which is formed in layers of the strip.

BACKGROUND OF THE INVENTION

Reference is made to co-pending applications on this subject matter Ser. No. 08/876,402 filed Jun. 16, 1997, now U.S. Pat. No. 5,921,064, Ser. No. 08/889,737 filed Jul. 8, 1997, now U.S. Pat. No. 5,927,051, Ser. No. 08/906,291 filed Aug. 5, 1997, now abandoned and Ser. No. 08/939,815, now U.S. Pat. No. 5,956,926, 08/939,444 and 08/939,881, both now abandoned, all filed Sep. 19, 1997.

The technique of festooning has been available for many years and is used in packaging many different types of material but particularly material of a fibrous nature such as fabric, non-woven strips and the like. In this technique, the strip is conventionally guided into a receptacle such as a cardboard box while a first reciprocating movement causes lengths of the strip to be laid across the receptacle and folded back and forth and a second reciprocating movement causes the positions of the lengths to be traversed relative to the receptacle transversely to the lengths. Normally the receptacle comprises a rigid rectangular container at least partly of cardboard having a base and four upstanding sides.

The purpose of the festooning method is for packaging the strip for supply to a machine using the strip. Some users prefer the festooned package relative to a wound package of this type of material since the packaged strip can simply be located adjacent the machine without the necessity for any unwinding or support stand. In addition, both the leading end and the tail end of the package are available at the top of the package so that a series of the packages can be connected lead to tail to act as an extended supply. Yet further, since the material is simply laid into the package, there is less problem with tension control in the material as it is withdrawn from the package, in comparison with wound packages where tension control of large packages can be a problem due to the inertia of the package thus requiring a driven unwind stand as well as material handling equipment for moving the large rolls. There is therefore no need when festooned packages are used for a complex unwind stand which takes up more space than may be available and involves significant cost for the unwind Stand and for the services to power the unwind stand.

Festooned packages are formed in a stiff container or box to properly enclose and contain the material and within which the material is stored during transportation for maintaining the material against compression and distortion due to the transfer of loads from surrounding packages. The cardboard container thus provides support for other similar containers in stacked condition and prevents the transfer of loads from the stacked packages from causing compression of packages at the bottom of a stack. The cardboard containers and the package structures used in the conventional arrangement however have a number of problems.

Firstly the container must be either recycled with the necessity of shipping the cardboard containers in the return direction to the supplier from the end user or they must be trashed, both at considerable expense.

Secondly the cardboard containers simply receive the material without significant compression so that there is wastage of space within the container due to the packaging of air with the material. In addition the conventional package structure does not minimize the amount of air spaces formed in the structure. The transportation costs of the material therefore are significantly increased by the large volume of the material which provides a density which is significantly below the optimum for most efficient transport.

Thirdly the presence of the essential box during formation of the structure provides a restriction to the proper control of the strip as it is laid down since the sides of the box provide limitations to the position and movement of the guide member controlling the strip.

Fourthly it has been noted that the sides of the box which are parallel to the strips as they are laid down do not closely confine the sides of the package structure with the significant danger that the strips can fall down between the edge of the package and the box side.

There remains therefore a significant requirement for a package of this type but the techniques presently available are unsatisfactory for the above reasons leaving opportunity for an improved package structure.

SUMMARY OF THE INVENTION

It is one object of the present invention, therefore, to provide an improved method of packaging a strip of material in which the stability of the package can be improved and in which the transportation of returned containers can be avoided.

According to one aspect of the invention there is provided a method of forming a package of a strip of material comprising:

a strip of material having a first side edge, a second side edge, a first surface and a second surface;

a plurality of layers or stacks of the strip;

each layer or stack comprising a plurality of folded portions of the strip, with each portion of the first layer being folded relative to the next portion about a line transverse to the strip;

the portions of each layer being arranged such that the first surface of each portion lies directly in contact with the first surface of a next adjacent portion, such that the second surface of each portion lies directly in contact with the second surface of a next adjacent portion, such that the first side edges of the portions lie in a first common plane of the layer and such that the second side edges of the portions lie in a second common plane of the layer parallel to the first plane;

the layers being parallel and arranged side by side such that the first and second planes of the each layer are parallel to the first and second planes of each of the other layers, thus defining first and second end layers and a plurality of intermediate layers and defining for each intermediate layer a first next adjacent layer on one side and a second next adjacent layer on an opposed side;

the strip being continuous through each layer from a first end portion of the strip at one end of the layer to a second end portion of the strip at an opposed end of the layer, such that a full extent of the strip from the first end portion to the second end portion can be unfolded from the layer by pulling the strip from either end portion;

one end portion of the strip of the first end layer forming a first end of the package for supply to an end use machine and one end portion of the strip of the second end layer forming a second end of the package for connection to a further package;

the first end portion of the strip of each intermediate layer being connected to one end portion of the strip of the first next adjacent layer and the second end portion of the strip of each intermediate layer being connected to one end portion of the second next adjacent layer;

such that the strip is continuous through the package and such that a full extent of the strip from the first end portion of said first end layer to said one end portion of said second end layer can be unfolded for supply to said end use machine.

The term "stack" is used hereinafter to refer to the separate layers of the strip. However it will be appreciated that the term does not imply any particular orientation of the stacks or layers since the layers can be vertical or horizontal as described hereinafter or can be in any other orientation as may occur as the package orientation is changed.

The number of stacks can of course vary so that additional stacks are included after the second above in the structure of the package with each being connected to the next.

Preferably the first plane of the second stack is immediately adjacent the second plane of the first stack.

Preferably the lengths of the first stack are parallel to the lengths of the second stack.

Preferably the lengths of the first stack are a right angles to the lengths of the second stack by rotating the orientation of the lengths as the stack is formed or after the stack is completed.

Preferably the first and second stacks are coextensive that is they have the same height and length.

Preferably a last laid length of the first stack is connected to a first laid length of the second stack by a traverse length portion extending diagonally therebetween.

Preferably an end of the strip at one end of the first stack is connected to an end of the strip at one end of the second stack by locating the leading and trailing ends and effecting a splice portion therebetween. This arrangement is particularly suitable when the stacks are formed independently and moved into place.

Preferably each stack is formed by laying the lengths between a pair of spaced guide plates for engaging and locating respectively the first and second edges of the strip.

Preferably the guide plates are removed after the stacks are formed and the stacks pressed together so as to be in intimate contact.

Preferably the package is wrapped by a flexible packaging material such that the stacks are pressed together by pressure from the packaging material.

Preferably each stack has a height from a first laid length to a last laid length thereof which is equal to a height of the package, that is each stack is formed up to the intended height of the package. However in an alternative arrangement, two or more stacks can be formed on top of each other so that each stack is only a portion of the height of the package.

Preferably the method includes closing and sealing the packaging material and causing compression of the package and extraction of air therefrom such that the package is in a compressed condition for transportation.

Preferably the method includes, when the package is completed, turning the package on to one side such that the lengths lie in a vertical plane for stacking further packages on top of the package.

Preferably the method includes, when the package is completed, turning the package on to one side such that the lengths lie in a vertical plane for unwinding each stack of the package in turn from a top of the package.

According to a second aspect of the invention there is provided a method of supplying a strip of material comprising providing a package as defined above, orienting the package so that the layers are horizontal with the first end layer at the top and the second end layer resting on a support surface, and pulling off the first end of the strip so as to unfold each strip in turn;

a strip of material having a first side edge, a second side edge, a a first surface and a second surface;

a first stack of lengths of the strip, with each length of the first stack being folded relative to the next length about a line transverse to the strip;

the lengths of the first stack being arranged such that the first surface of each length lies directly in contact with the second surface of a previously laid strip, such that the first side edges of the lengths of the first stack lie in a first common plane of the first stack and such that the second side edges of the lengths of the first stack lie in a second common plane of the first stack parallel to the first plane;

a second stack of lengths of the strlp, with each length of the second stack being folded relative to the next length about a line transverse to the strip;

the lengths of the second stack being arranged such that the first surface of each length lies directly in contact with the second surface of a previously laid strip, such that the first side edges of the lengths of the second stack lie in a first common plane of the second stack and such that the second side edges of the lengths of the second stack lie in a second common plane of the second stack parallel to the first plane;

the first and second planes of the second stack being parallel to the first and second planes of the first stack;

an end of the strip at one end of the first stack being connected to an end of the strip at one end of the second stack.

One embodiment of the invention will now be described in conjunction with the accompanying drawings in which:

DETAILED DESCRIPTION

Figure 2:
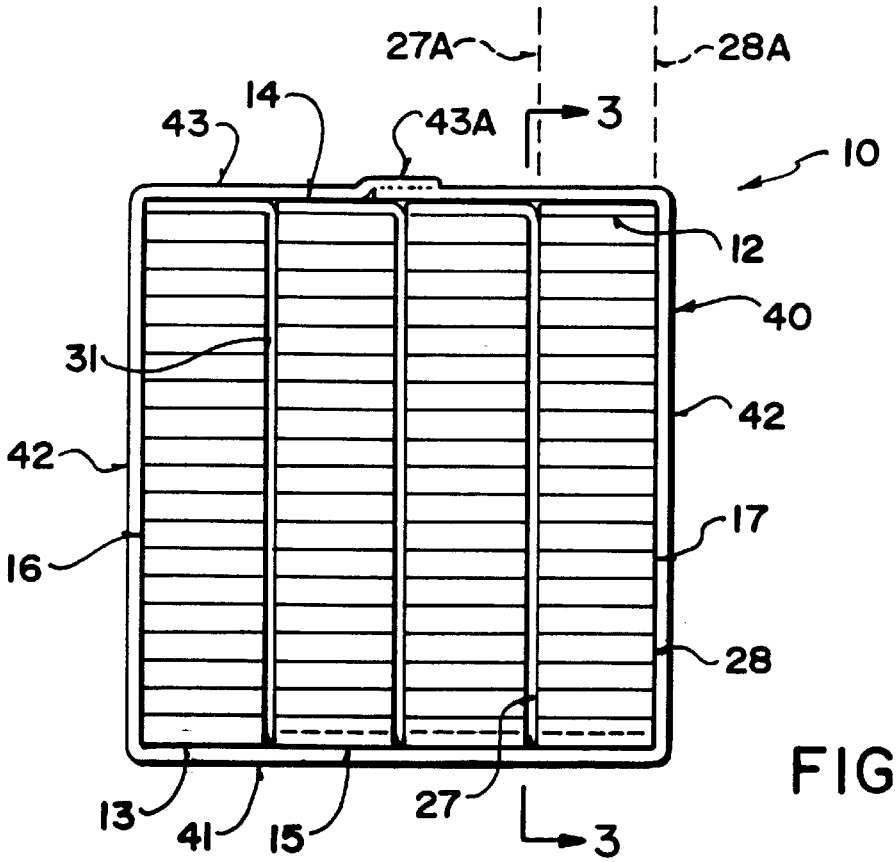
FIG. 2 is a cross sectional view along the lines 2—2 of FIG. 1.
Figure 3:
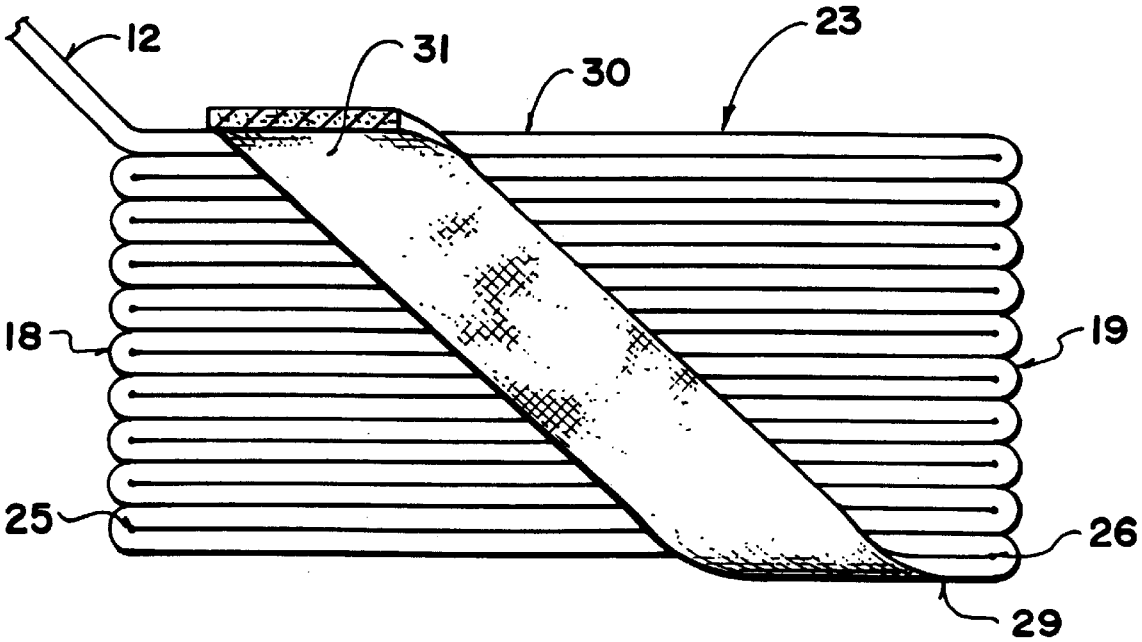
FIG. 3 is a cross sectional view along the lines 3—3 of FIG. 1.
Figure 4:
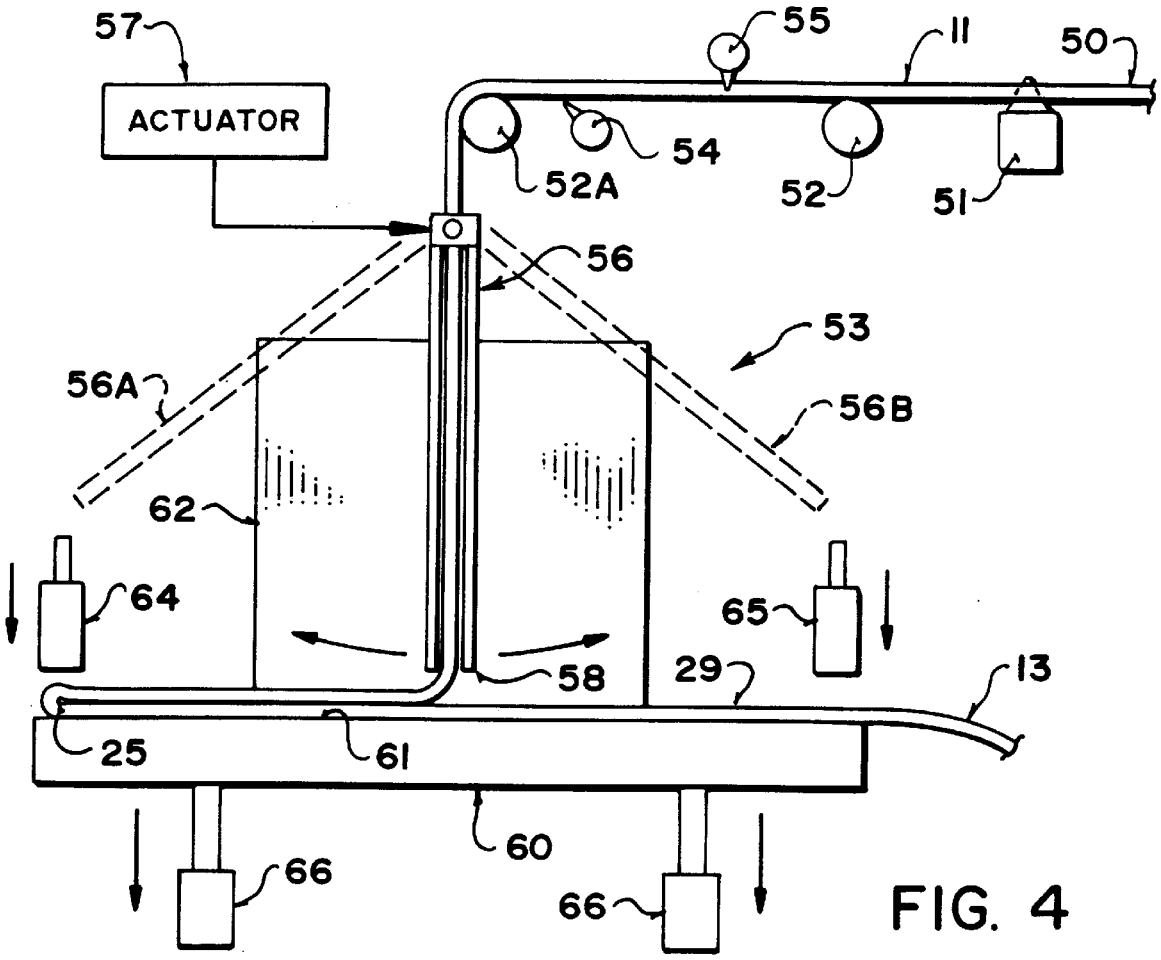
FIG. 4 is a side elevational view of an apparatus and method for forming the package of FIG. 1.
Figure 5:
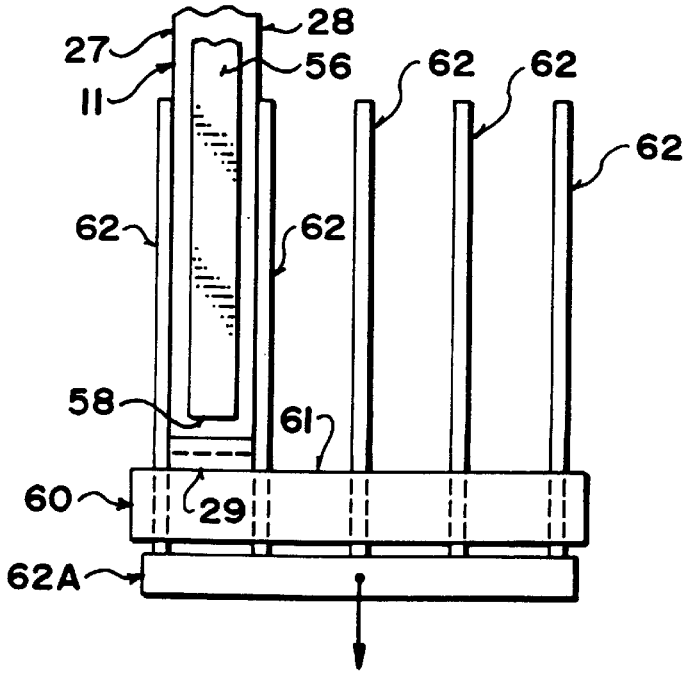
FIG. 5 is an end elevational view of one part of the apparatus of FIG. 4.

The package structure of the present invention is shown in FIGS. 1, 2, 3 and 6 and a method for forming the package shown in these figures is shown in FIGS. 4 and 5.

Figure 1:
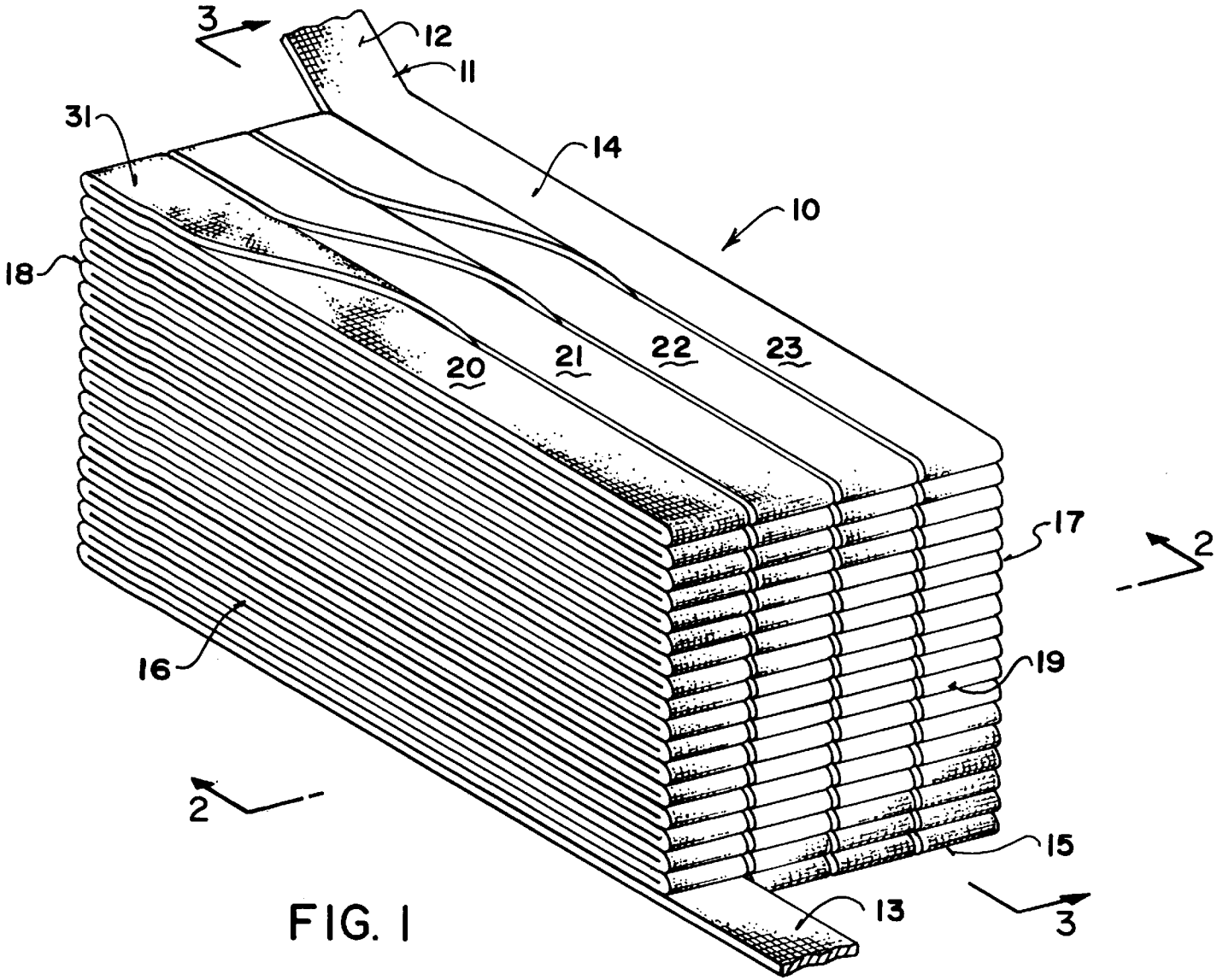
FIG. 1 is a schematic isometric view of a package according to the present invention.

As shown in FIGS. 1, 2 and 3, the package comprises a generally rectangular body 10 formed from a strip or sheet 11 of a pliable material to be packaged and generally this material will be of a fibrous nature formed by woven or non-woven material although this is not essential to the package structure. The strip has a leading end 12 and a trailing end 13 of the package and otherwise is substantially continuous through the package. The package has a top 14, a bottom 15, two sides 16 and 17 and two ends 18 and 19.

The package is formed by a plurality of stacks or layers of strips. In the embodiments shown in FIGS. 1, 2 and 3, there are four stacks or layers of the strip indicated respectively at 20, 21, 22 and 23. The stacks are parallel and an outer side of the stack 20 forms the side surface 16 of the package and an outer side of the stack 23 forms the side 17 of the package.

It will of course be appreciated that the dimensions of the package can of course be varied in accordance with the requirement so that the number of stacks, the length of each stack and the height of each stack can be varied.

Each stack of the strip comprises a plurality of lengths of the strip which are laid on top of one another. Thus as shown in FIG. 3 the lengths are folded back and forth to form accordian folds at respective end fold lines 25 and 26 so that the fold lines lie in a common vertical plane defining the ends 18 and 19 of the package. The lengths of the strip lie directly each on top of the previous length so that with the strip being of constant width as shown, the side edges 27 and 28 of the lengths of strip lie in common vertical planes 27A, 28A as shown in FIG. 2 In other words, the side edges 27 of the strips are aligned and similarly, the side edges 28 of the strips are aligned.

Thus the package is formed by laying the lengths each on top of the next from a bottom length 29 up to a top length 30 to form the stack. At the top length 30 of the stack 20, when that stack is complete, a length 31 of the strip is traversed from the stack 20 to the stack 21 so as to form the bottom length 29 of the next stack.

Each stack is thus formed in turn from the stack 20 through to the stack 23 and each stack is connected to the next by the traversed length 31 which turns across the top of the stack 20, down the side of the stack and then turns across the bottom of the stack 21 to form the bottom length 29. This arrangement is shown in FIG. 3.

The completed package is-thus formed from the plurality of stacks each of which has a length equal to that of the other stacks and therefore equal to that of the package and a height equal to that of the stacks and therefore equal to the height of the package.

In an alternative arrangement, after the stacks are complete as shown in FIG. 1, an additional layer of stacks can be applied each on top of a previous stack. Thus an additional stack could be applied on top of the stack 20 and three further stacks applied on top of each of the further stacks 21, 22 and 23. In this way a completed package structure might be made up of two or more such stack portions.

When completed, the package can be wrapped by a flexible packaging material preferably of heat sealable non-permeable plastics which encompasses the whole of the package as indicated at 40. The packaging material includes a base 41 and sides 42 with a top 43 wrapped over the top of the package and heat sealed as indicated at 43A. The sealed package allows air to be extracted from the package which can be used with physical compression from the top of the package so as to compress the package to a reduced height with the expelled air being extracted from the package in a vacuum packaging system. The amount of compression can be determined so as to minimize the volume of the package without interfering with the required loft of the product when extracted from the package. In this way the package structure avoids the necessity for rigid sides of a box or similar container so the package structure is stable due to the compression of the stacks to reduce the height of the stacks and due to the compression of each stack against the sides of the next adjacent stack.

When wrapped, compressed and sealed, the package structure can be turned onto one side so that the side 16 lies on a support surface and the side 17 is uppermost. In this orientation, the application of vertical loads onto the package from other packages causes the transfer through the package structure to the support surface carrying the side 16 without distorting or damaging the strip. This occurs due to the fact that the strip is relatively stiff across its width and when compressed into the stacks, the strips together form a substantially rigid structure so there is little distortion of the strip in the transverse direction by the application of these loads.

Figure 6:
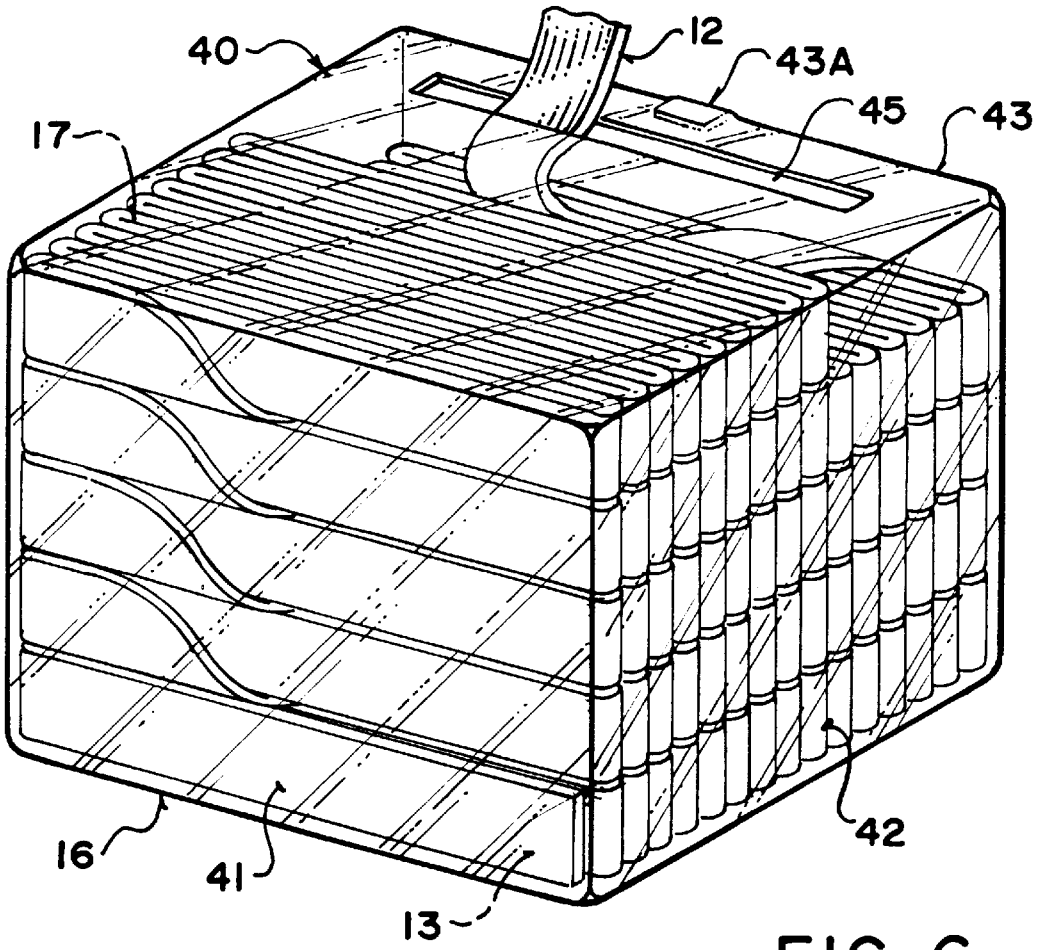
FIG. 6 is an isometric view of a package similar to that of FIG. 1 arranged for unwinding of the strip from the package.

This orientation of the package is shown in FIG. 6. In addition this orientation can be used for unwinding the package. Thus in FIG. 6 a partial unwinding of the structure is shown in that a slot 45 is cut in one side of the packaging material 40 adjacent the top 43 and the leading end 11 of the strip is found and pulled through the slot. By placing the package on one side, therefore, each stack in turn can be unwound without the danger of the stack toppling since it is lying on its side supported by the underlying stacks.

Turning now to the method of formation of the package structure illustrated in FIGS. 4 and 5, the strip 11 is formed by slitting from a web 50 using a slitter bar 51. The packaging system illustrated in FIGS. 4 and 5 therefore comprises only one of a number of such packaging systems each of which will act to package a certain one of the strips slit by the slitter bar 51 from the wider web 50. The strip 11 is forwarded by a feed system schematically indicated at 52 to the package forming apparatus generally indicated at 53.

Optionally, pre-folding elements 54 and 55 may be provided which act upon the strip 11 to crimp the strip 11 to define the folds 25, 26 to assist in laying the lengths in the stack as previously described. The pre-folding elements 54 and 55 are shown only schematically but can comprise a roller which is arranged to engage the strip with a crimping bar at the predetermined required spacing to effect the folding action at the spaces along the length of the strip to allow the lengths to be formed as previously described.

The strip is then forwarded over a feed roller 52A forming part of the feeding system to a reciprocating wand 56 driven by an actuator schematically indicated at 57. The wand moves back and forth in a direction longitudinal of the strip between extreme positions indicated at 56A and 56B. The wand provides surfaces which guide the strip in its forward movement and control the discharge of the strip from a lower end 58 of the wand 56. The wand 56 is designed so that it has an effective width less than that of the strip so that it can guide the strip without interfering with side edges 27 and 28 of the strip.

A support member 60 provides a horizontal upper surface 61 onto which the stacks are laid.

The support 60 includes a plurality of upstanding guide spacer sheets 62 which are spaced each from the next a distance just to receive the width of the strip. The guide spacer sheets are parallel and arranged longitudinal to the stacks so that each pair of strips defines an area for receiving a respective one of the stacks. The spacer sheets can be formed from thin stainless steel sufficient in strength only to provide a support to prevent the stacks from toppling during formation of the stack. In this way using the spacer sheets, the stacks can be built up to a significant height, for example as much as four feet.

The wand 56 is thus moved back and forth across the surface 61 and between the spacer sheets 62 so as to lay down each stack in turn from the bottom length 29 of each stack to a top length (not shown).

Tampers 64 and 65 may be provided for engaging each fold 25, 26 after the material is discharged by the wand so as to tamp down the fold to ensure that it is properly compressed. In the optional arrangement where the prefolding elements 54 and 55 are provided, the tampers 64 and 65 may not be necessary.

The support 60 is mounted on actuators 66 which can move the support vertically downwardly as the stack is formed. In this way the surface 61 is moved away from the wand as each length is laid on the stack. When the stack is complete, the support 60 is moved vertically upwardly during the formation of the traverse portion 31 so that the next stack commences at the surface 61 and is built gradually up to the top layer 30.

The support 60 as shown can be free from end elements engaging or locating the stacks and the spacer sheets 62 may as shown extend only over a part of the lengths sufficient only to support the lengths against toppling. The lengths of material are often relatively stiff so that once guided at one part to lay directly on top of a previous length, the remainder of the length remains in a straight line to avoid skewing and twisting.

The support 60 is also moveable in steps horizontally so as to step between each stack and the next stack during the traverse section 31.

When the package structure is complete, the spacer sheets 62 mounted on a common support 62A can be withdrawn from the support 60 to pull the spacer sheets out of the package from their position between the stacks. At this time there is little compression on the stacks so that the withdrawal can be effected without application of significant force. Once the spacer sheets are withdrawn, the wrapping by the packaging material 40 can be effected which will act to compress the stacks in the horizontal direction pushing them together and also to compress the stacks vertically downwardly as previously described.

In this way the package is stable without the necessity for a rigid containing box and once the stacks are wrapped together, the combination of stacks prevents any one stack from toppling. The package can therefore be shipped without the necessity for a stiff or rigid box or containing due to the stability of the stacks when they are combined by the wrapping action. The sides of the package are stable without any possibility of lengths from slipping out of the package since all of the lengths are held in place by frictional engagement with lengths above and below the lengths. There is no free part of each length which hangs out the side of the package which could otherwise become detached. All of these features therefore obviate the necessity for the conventional rigid container which has up till now been considered essential to the festooning type package.

Figure 7:
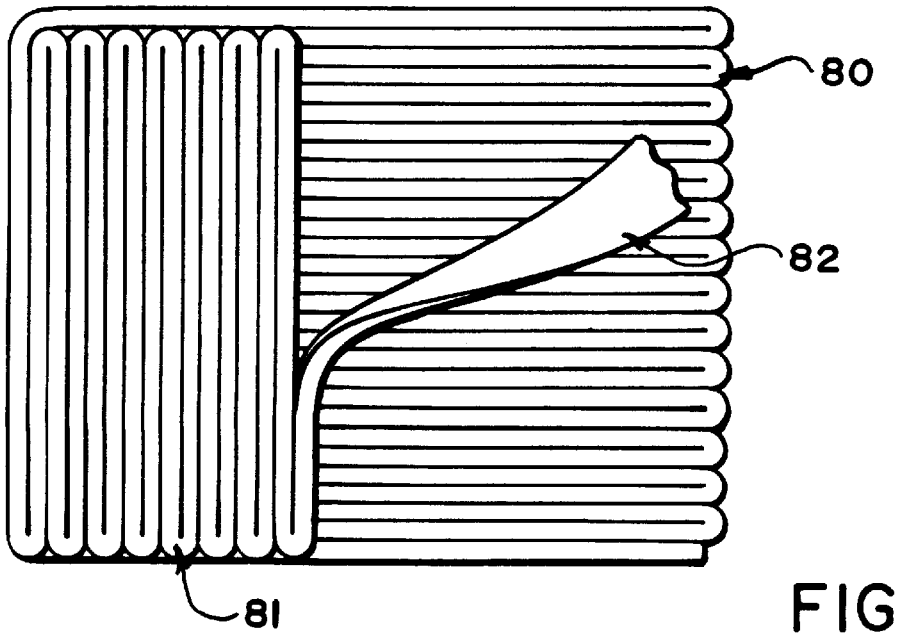
FIG. 7 is a top plan view of an alternative form of the package which is partially unwound, In the drawings like characters of reference indicate corresponding parts in the different figures.

In FIG. 7 is shown an alternative structure in which a first stack 80 has been formed and a second stack 81 is applied next to the first stack 80 but oriented so that the lengths of the stack 81 are arranged at right angles to the lengths of the stack 80. This arrangement prevents interleaving of the lengths due to sideways compressive forces. Again the unwinding of the strip as indicated at 82 is effected by firstly unwinding the stack 81 following which the interconnection between the stack 81 and the stack 80 commences automatically unwinding of the stack 80.

As shown in FIGS. 1, 2 and 3, the interconnecting portion 31 extends from the top of one stack down the side of that stack and into the bottom of the next stack. Alternative arrangements for interconnection of the stacks can be provided depending upon the method of formation of the stacks. Thus each stack may be connected to the next by a connecting portion which extends from the top of one stack to the top of the next stack. This can in some cases be effected by splicing or it can be effected by alternating the direction of the building of the stack. Thus a first stack can be built from one end to an opposed end and the next stack is built from the opposed end back toward the first end. This type of building can be effected by rotating the package orientation so that the package is formed on its side or the package is inverted between stacks. Furthers the stacks may be formed independently and when each stack is completed it is moved to a position alongside the previous stack. However, when the package is completed for unwinding, the stacks are interconnected in that the tail end of each stack is connected to a lead end of the previous stack to ensure that the complete package unwinds as a continuous strip.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A package comprising:

a plurality of stacks of strip material, each stack formed of a strip of material having a first side edge, a second side edge, a first surface and a second surface;

each stack comprising a plurality of folded portions of the strip, wherein each portion of the respective stack is folded relative to the next portion about a line transverse to the strip;

such that the first surface of each portion lies against the first surface of a next adjacent portion and the second surface of each portion lies against the second surface of a next adjacent portion;

such that the first side edges of the portions are aligned and also the second side edges of the portions are aligned;

wherein the plurality of stacks of the strip are arranged parallel and side by side abutting against and supporting each other, thus defining at least first and second adjacent stacks;

the strip being continuous through each stack from a first end portion of the strip at one end of the stack to a second end portion of the strip at an opposed end of the stack, such that a fill extent of the strip from the first end portion to the second end portion can be unfolded from the stack by pulling the strip from either end portion;

one end portion of the strip of the first stack forming a first end of the package for supply to an end use machine and one end portion of the strip of another stack at an opposed end of the package forming an end for connection to a further package; and an end of the first end portion of the strip of one stack connected to an end of one end portion of the strip of the next adjacent stack, such that the strip is continuous through the package and such that a full extent of the strip from the first end portion of said first stack to said one end portion of said stack at the opposed end of the package can be unfolded for supply to the end use machine.

2. The package according to claim 1 wherein the portions of the strip in all of the stacks are parallel.

3. The package according to claim 1 wherein the stacks are coextensive such that the package is rectangular.

4. The package according to claim 1 wherein the portions of the strip of each stack are of constant width such that the side edges thereof each lie in a common plane parallel to the second sides of the package.

5. The package according to claim 1 wrapped by a flexible packaging material such that the stacks are held together by pressure from the packaging material.

6. The package according to claim 1 wrapped by a flexible packaging material comprising a closed bag from which air has been withdrawn which is sealed against ingress of air such that the stacks are maintained in a compressed condition in a direction at right angles to the surfaces of the portions of the strip by atmospheric pressure on the packaging material.

7. The package according to claim 1 wherein the stacks are arranged each alongside the next without intervening rigid container walls.

8. The package according to claim 1 wherein the connection between a last laid strip portion of the first stack and a first laid strip portion of the second stack is a traverse length portion extending diagonally therebetween.

9. The package according to claim 1 wherein the side edges of the strip portions of each stack directly contact the side edges of the next adjacent stack.

10. A method of forming a package comprising:

providing a strip of material having a first side edge, a second side edge, a first surface and a second surface;

folding the strip to form at least a first stack and a second stack of the strip;

each stack comprising a plurality of folded portions of the strip, wherein each portion of the stack is folded relative to the next portion about a line transverse to the strip;

such that the first surface of each portion lies against the first surface of a next adjacent portion and the second surface of each portion lies against the second surface of a next adjacent portion; and such that the first side edges of the portions are aligned and also the second side edges of the portions are aligned;

the strip being continuous through each stack from a first end portion of the strip at one end of the stack to a second end portion of the strip at an opposed end of the stack, such that a fill extent of the strip from the first end portion to the second end portion can be unfolded from the stack by pulling the strip from either end portion;

wherein the strip is folded to form the second stack subsequent to formation of the first stack and wherein the second stack is formed alongside and parallel to the first stack so that adjacent stacks abut and support each other.

11. The method according to claim 10 wherein the portions of the strip in all of the first and second stacks are parallel.

12. The method according to claim 10 wherein the first and second stacks are coextensive such that the package is rectangular.

13. The method according to claim 10 further comprising wrapping the package by a flexible packaging material such that the first and second stacks are held together by pressure from the packaging material.

14. The method according to claim 10 further comprising wrapping the package by a flexible packaging material comprising a closed bag from which air has been withdrawn which is sealed against ingress of air such that the first and second stacks are maintained in a compressed condition in a direction at right angles to the surfaces of the portions of the strip by atmospheric pressure on the packaging material.

15. The method according to claim 10 further comprising arranging the stacks each alongside the next without intervening rigid container walls.

16. The method according to claim 10 further comprising connecting a last laid strip portion of the first stack to a first laid strip portion of the second stack by a traverse length portion extending diagonally thereacross.

17. The method according to claim 10 wherein the side edges of the strip portions of each stack directly contact the side edges of the next adjacent stack.

18. The method according to claim 10 wherein the portions of the strip of each stack are of constant width such that the side edges thereof each lie in a common plane.

19. A package comprising:

a plurality of stacks of strip material, each stack formed of a strip of material having a first side edge, a second side edge, a first surface and a second surface;

each stack comprising a plurality of folded portions of the strip, wherein each portion of the respective stack is folded relative to the next portion about a line transverse to the strip;

such that the first surface of each portion lies against the first surface of a next adjacent portion and the second surface of each portion lies against the second surface of a next adjacent portion;

such that the first side edges of the portions are aligned and also the second side edges of the portions are aligned;

wherein the plurality of stacks of the strip are arranged parallel and side by side thus defining at least first and second stacks such that the side edges of the strip portions of one stack are adjacent the side edges of the strip portions of the next adjacent stack abutting against and supporting each other;

the strip being continuous through each stack from a first end portion of the strip at one end of the stack to a second end portion of the strip at an opposed end of the stack, such that a full extent of the strip of each stack from the first end portion to the second end portion can be unfolded from the stack by pulling the strip from either end portion;

the stacks being arranged such that the first end portions of all of the stacks are at one end of the package and the second end portions of all of the stacks are at the opposed end of the package;

the first end portion of the strip of the first stack forming a first end of the package for supply to an end use machine and the second end portion of the strip of a stack forming an end of the package for connection to a further package;

the end of the first end portion of the strip of one stack being connected to the end of the second end portion of the strip of the next adjacent stack by a connecting portion which extends between the adjacent side edges of the stacks;

such that the strip is continuous through the package and such that a full extent of the strip from the first end portion of said first stack to said one end portion of said second end stack can be unfolded for supply to said end use machine.

20. The package according to claim 19 wherein the portions of the strip of each stack are of constant width such that the side edges thereof each lie in a common plane.

21. The package according to claim 19 wherein the stacks are wrapped together for transportation and storage by a flexible packaging material wrapped around an outside of the package and wherein the flexible packaging material comprises a closed bag from which air has been withdrawn which is sealed against ingress of air such that the stacks are maintained in a compressed condition in a direction at right angles to the surfaces of the portions of the strip by atmospheric pressure on the packaging material.

22. A package comprising:

a plurality of stacks of strip material, each stack formed of a strip of material having a first side edge, a second side edge, a first surface and a second surface;

each stack comprising a plurality of folded portions of the strip, wherein each portion of the respective stack is folded relative to the next portion about a line transverse to the strip;

such that the first surface of each portion lies against the first surface of a next adjacent portion and the second surface of each portion lies against the second surface of a next adjacent portion;

such that the first side edges of the portions are aligned and also the second side edges of the portions are aligned;

wherein the plurality of stacks of the strip are arranged parallel and side by side thus defining at least first and second adjacent stacks;

the strip being continuous through each stack from a first end portion of the strip at one end of the stack to a second end portion of the strip at an opposed end of the stack, such that a full extent of the strip from the first end portion to the second end portion can be unfolded from the stack by pulling the strip from either end portion;

one end portion of the strip of the first stack forming a first end of the package for supply to an end use machine and one end portion of the strip of another stack at an opposed end of the package forming an end for connection to a further package; and an end of the first end portion of the strip of one stack connected to an end of one end portion of the strip of the next adjacent stack, such that the strip is continuous through the package and such that a full extent of the strip from the first end portion of said first stack to said one end portion of said stack at the opposed end of the package can be unfolded for supply to the end use machine, wherein the package is oriented such that the stacks are horizontal and such that loads from upper stacks are transferred to lower stacks through edges of the strip.

* * * * *